US005595303A

United States Patent [19]

Weeks et al.

[11] Patent Number: 5,595,303

[45] Date of Patent: Jan. 21, 1997

[54] MULTI-FUNCTION TOILET ACCESSORY

[76] Inventors: Jane Weeks; Tammy Searcy, both of 149 George Flowers Rd., Norman Park, Ga. 31771

[21] Appl. No.: 616,160

[22] Filed: Mar. 14, 1996

(Under 37 CFR 1.47)

[51] Int. Cl.[6] ..... A45C 11/00; B65D 85/672

[52] U.S. Cl. ..... 206/576; 206/225; 206/349

[58] Field of Search ..... 206/576, 581, 206/225, 233, 349, 361, 389, 397, 408, 415, 416, 823

[56] References Cited

U.S. PATENT DOCUMENTS 4,432,451 2/1984 Hooses ..... 206/225 X 5,040,679 8/1991 Rehmann ..... 206/225 X 5,456,356 10/1995 Kurzawa ..... 206/225 X

*Primary Examiner*—Jacob K. Ackun

[57] ABSTRACT

A multi-function toilet accessory including a main housing having a top wall having an elongated recess extending inwardly from an open rear thereof. The top wall has a square recess formed therein coextensive with one of a pair of side walls thereof. The open rear has an upwardly extending lip integral with a rear edge of the bottom wall of the main housing. A toilet paper dispensing portion is secured to the top wall of the main housing. A deodorizer portion is dimensioned for securement within the square recess of the main housing.

6 Claims, 3 Drawing Sheets

MULTI-FUNCTION TOILET ACCESSORY

BACKGROUND OF THE INVENTION

1. Field of the Invention

The present invention relates to a multi-function toilet accessory and more particularly pertains to holding and concealing toilet articles with a multi-function toilet accessory.

2. Description of the Prior Art

The use of toilet brush holders is known in the prior art. More specifically, toilet brush holders heretofore devised and utilized for the purpose of concealing a toilet brush or plunger are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,040,679 to Rehmann discloses a toilet accessory for concealing toilet articles.

U.S. Pat. No. 3,450,452 to Reid discloses a toilet brush holder.

U.S. Pat. No. Des. 292,631 to Tash discloses the ornamental design for a combined toilet bowl plunger and holder.

U.S. Pat. No. Des. 345,271 to Vetter discloses the ornamental design for a toilet brush holder.

U.S. Pat. No. Des. 329,775 to Murphy discloses the ornamental design for a toilet bowl brush holder.

U.S. Pat. No. Des. 298,712 to Mattel discloses the ornamental design for a holder for a toilet bowl brush.

While these devices fulfill their respective, particular objective and requirements, the aforementioned patents do not describe a multi-function toilet accessory for holding and concealing toilet articles.

In this respect, the multi-function toilet accessory according to the present invention substantially departs from the conventional concepts and designs of the prior art, and in doing so provides an apparatus primarily developed for the purpose of holding and concealing toilet articles.

Therefore, it can be appreciated that there exists a continuing need for new and improved multifunction toilet accessory which can be used for holding and concealing toilet articles. In this regard, the present invention substantially fulfills this need.

SUMMARY OF THE INVENTION

In the view of the foregoing disadvantages inherent in the known types of toilet brush holders now present in the prior art, the present invention provides an improved multi-function toilet accessory. As such, the general purpose of the present invention, which will be described subsequently in greater detail, is to provide a new and improved multi-function toilet accessory and method which has all the advantages of the prior art and none of the disadvantages.

To attain this, the present invention essentially comprises a main housing having a generally rectangular configuration. The main housing has a front wall, an open rear, a top wall, a bottom wall, a pair of side walls, and a hollow interior. The top wall has an elongated recess extending inwardly from the open rear. The elongated recess extends more than three quarters of a width of the main housing. The top wall has a square recess formed therein coextensive with one of the pair of side walls. The square recess has a lower surface comprised of a perforated grid. The open rear has an upwardly extending lip integral with a rear edge of the bottom wall of the main housing. The device includes a toilet paper dispensing portion comprised of a pair of upwardly extending walls secured to the top wall of the main housing. Each of the walls has a recess formed on an inner surface downwardly of free ends thereof. The toilet paper dispensing portion further comprises a spring biased spool adapted for removable securement between the upwardly extending walls within the recesses therein. The device includes a deodorizer portion comprised of a tablet having an upper surface and a lower surface. The lower surface has an adhesive disposed thereon. The adhesive has a peel-away sheet disposed thereon. The tablet is dimensioned for securement to the perforated grid of the square recess of the main housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved multi-function toilet accessory which has all the advantages of the prior art toilet brush holders and none of the disadvantages.

It is another object of the present invention to provide a new and improved multi-function toilet accessory which may be easily and efficiently manufactured and marketed.

It is a further object of the present invention to provide a new and improved multi-function toilet accessory which is of durable and reliable construction.

An even further object of the present invention is to provide a new and improved multi-function toilet accessory which is susceptible of a low cost of manufacture with regard to both materials and labor, and which accordingly is then susceptible of low prices of sale to the consuming public, thereby making such a multi-function toilet accessory economically available to the buying public.

Still yet another object of the present invention is to provide a new and improved multi-function toilet accessory which provides in the apparatuses and methods of the prior art some of the advantages thereof, while simultaneously overcoming some of the disadvantages normally associated therewith.

Even still another object of the present invention is to provide a new and improved multi-function toilet accessory for holding and concealing toilet articles.

Lastly, it is an object of the present invention to provide a new and improved multi-function toilet accessory including a main housing having a top wall having an elongated recess extending inwardly from an open rear thereof. The top wall has a square recess formed therein coextensive with one of a pair of side walls thereof. The open rear has an upwardly extending lip integral with a rear edge of the bottom wall of the main housing. A toilet paper dispensing portion is secured to the top wall of the main housing. A deodorizer portion is dimensioned for securement within the square recess of the main housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
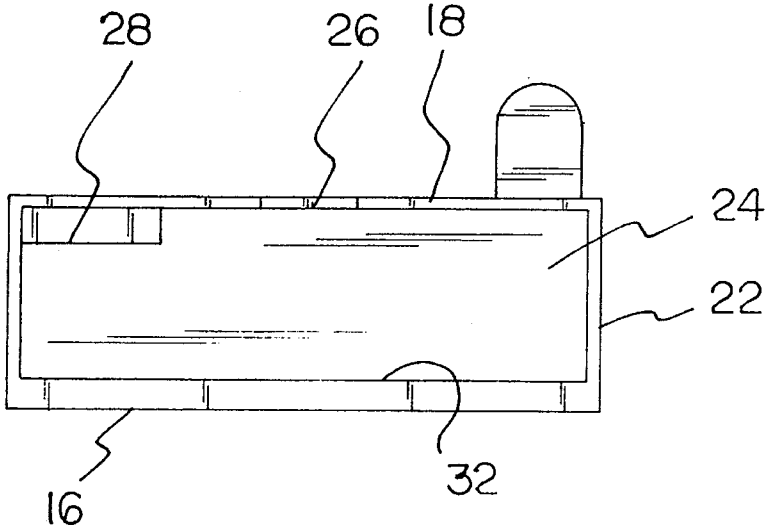
FIG. 2 is a rear elevation view of the present invention.
Figure 1:
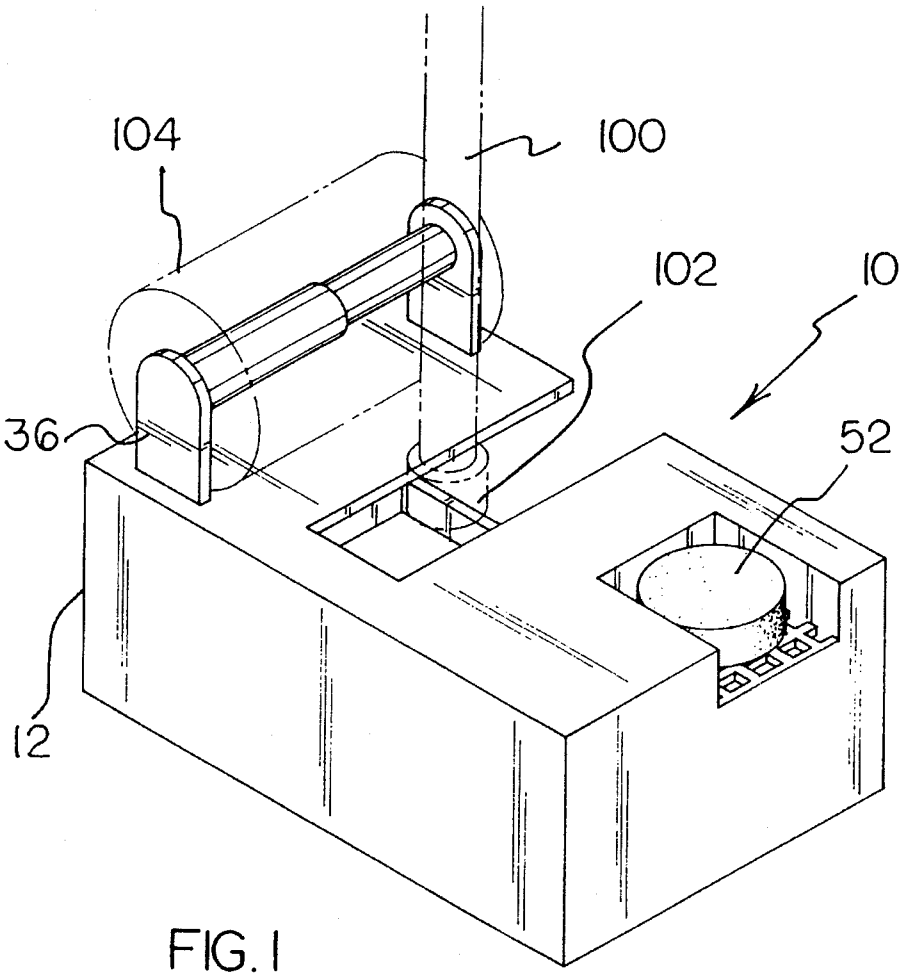
FIG. 1 is a perspective view of the preferred embodiment of the multi-function toilet accessory constructed in accordance with the principles of the present invention.
Figure 4:
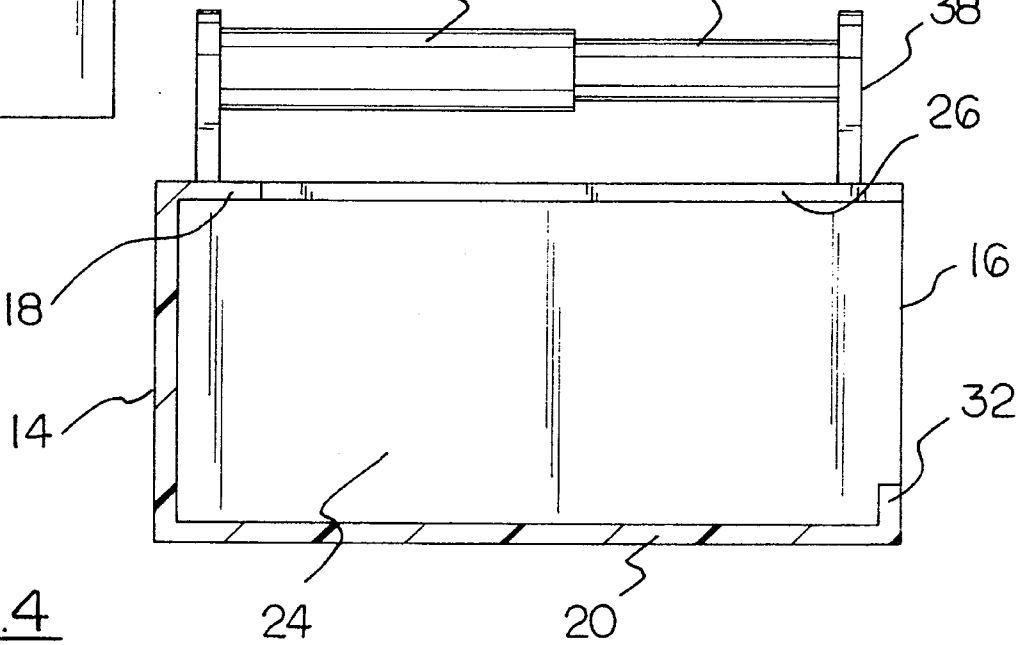
FIG. 4 is a cross-sectional view as taken along line 4—4 of FIG. 3.
Figure 3:
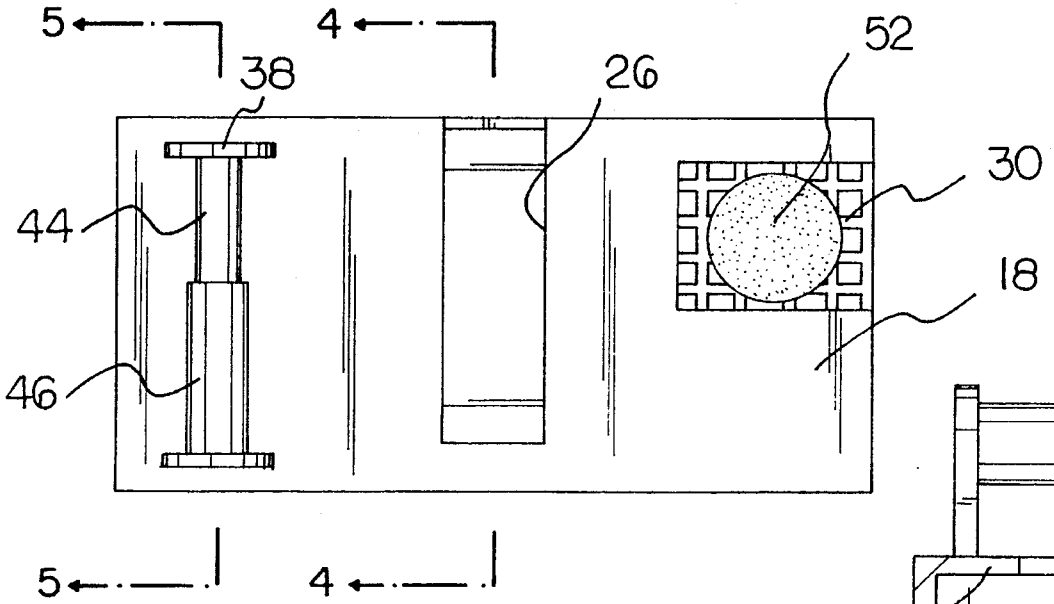
FIG. 3 is a plan view of the preferred embodiment of the present invention.
Figure 5:
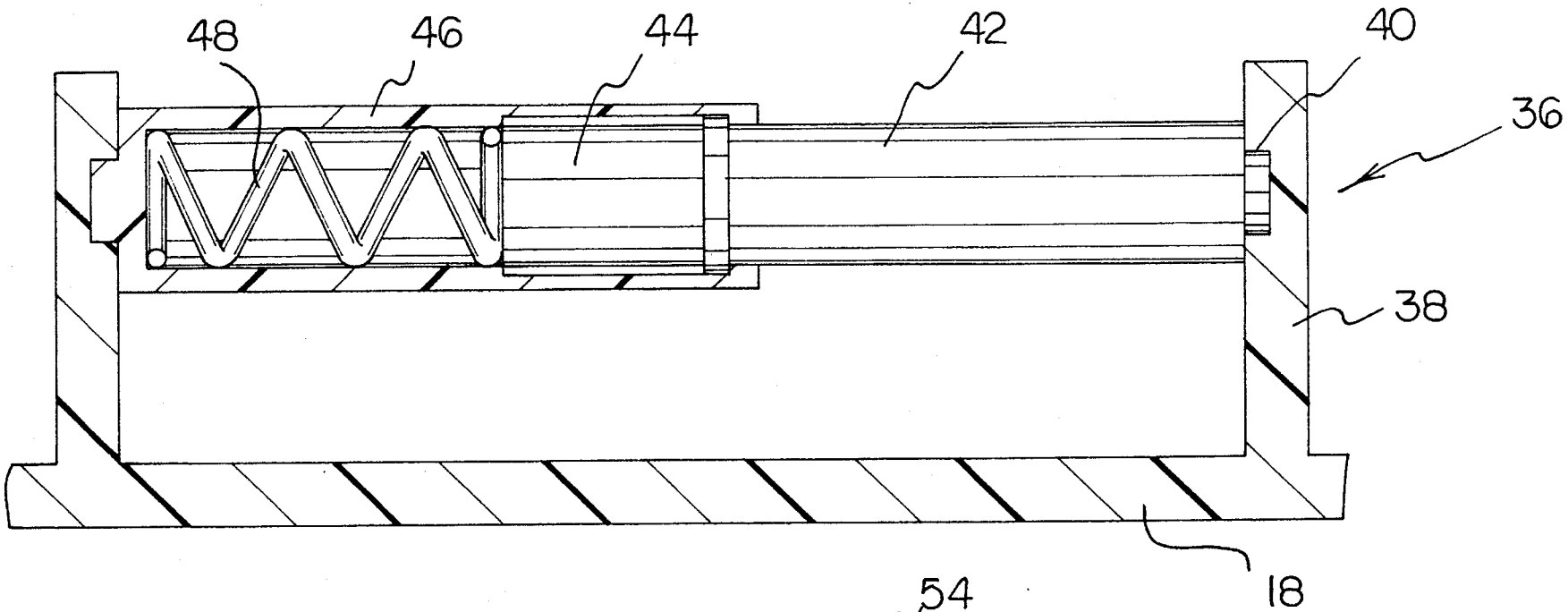
FIG. 5 is a cross-sectional view as taken along line 5—5 of FIG. 3.
Figure 6:
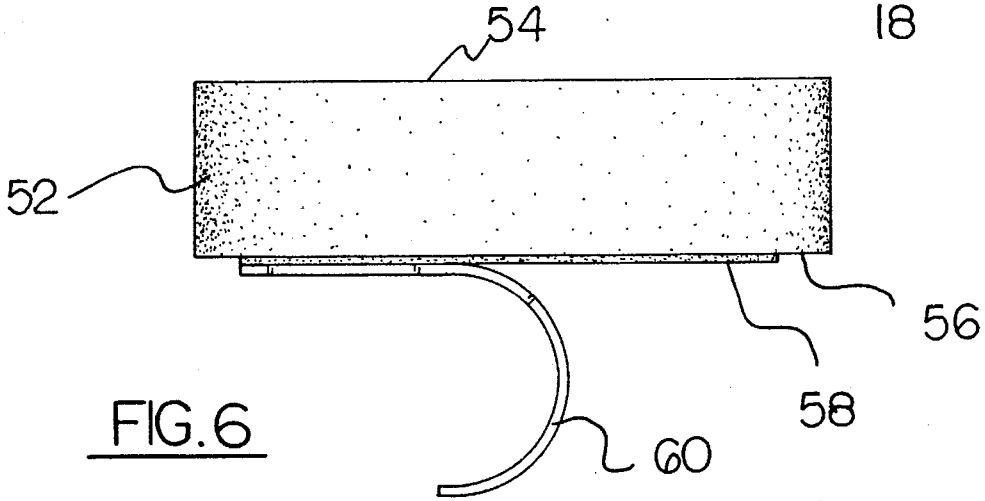
FIG. 6 is a side view of the deodorizer of the present invention.

With reference now to the drawings, and in particular, to FIGS. 1–6 thereof, the preferred embodiment of the new and improved multi-function toilet accessory embodying the principles and concepts of the present invention and generally designated by the reference number 10 will be described.

Specifically, it will be noted in the various Figures that the device relates to a new and improved multi-function toilet accessory for holding and concealing toilet articles. In its broadest context, the device consists of a main housing, a toilet paper dispensing portion, and a deodorizer portion. Such components are individually configured and correlated with respect to each other so as to attain the desired objective.

The device 10 includes a main housing 12 having a generally rectangular configuration. The preferable dimensions of the main housing 12 include a height of six inches, a length of eight inches and a width of eight inches. The preferable construction of the main housing 12 is of a rigid plastic. The main housing 12 has a front wall 14, an open rear 16, a top wall 18, a bottom wall 20, a pair of side walls 22, and a hollow interior 24. The top wall 18 has an elongated recess 26 extending inwardly from the open rear 18. The elongated recess 26 has a preferable width of one and half inches. The elongated recess 26 extends more than three quarters of a width of the main housing 12. The width of the elongated recess 26 allows for a shaft 100 of a plunger 102 to pass therethrough. The top wall 18 has a square recess 28 formed therein coextensive with one of the pair of side walls 22. The square recess 28 has a lower surface comprised of a perforated grid 30. The perforated grid 30 allows for air to exit from the hollow interior 24. The open rear 16 has an upwardly extending lip 32 integral with a rear edge of the bottom wall 20 of the main housing 12. The lip 32 preferably extends upwardly ¼ of an inch from the bottom wall 20. Once the plunger 102 is positioned within the main housing 12, the lip 32 prevents toilet water from the plunger 102 from running out of the main housing 12. The main housing 12 is dimensioned for placement adjacent to a toilet bowl to allow for easy access by a user.

The device 10 also includes a toilet paper dispensing portion 36 comprised of a pair of upwardly extending walls 38 secured to the top wall 18 of the main housing 12. Each of the walls 38 has a recess 40 formed on an inner surface downwardly of free ends thereof. The toilet paper dispensing portion 36 further comprises a spring biased spool 42 adapted for removable securement between the upwardly extending walls 38 within the recesses 40 therein. The spring biased spool 42 is comprised on an inner shaft 44 and a hollow outer shaft 46. The hollow outer shaft 46 has a spring 48 disposed therein. The inner shaft 44 slides within the hollow outer shaft 46 to allow for the removal of the spool 42 from between the walls 38. The spring 48 serves to bias the inner shaft outwardly of the hollow outer shaft 46. The spool 42 is adapted to hold a standard roll of toilet paper 104 thereon.

Lastly, the device 10 includes a deodorizer portion comprised of a tablet 52 having an upper surface 54 and a lower surface 56. The lower surface 56 has an adhesive 58 disposed thereon. The adhesive 58 has a peel-away sheet 60 disposed thereon. The tablet 52 is dimensioned for securement to the perforated grid 30 of the square recess 28 of the main housing 12. The tablet 52 serves to provide a pleasant aroma to mask odors normally present in a bathroom. The tablet 52 can be replaced once its usefulness has been depleted.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A multi-function toilet accessory for holding and concealing toilet articles comprising, in combination:

a main housing having a generally rectangular configuration, the main housing having a front wall, an open rear, a top wall, a bottom wall, a pair of side walls, and a hollow interior, the top wall having an elongated recess extending inwardly from the open rear, the elongated recess extending more than three quarters of a width of the main housing, the top wall having a square recess formed therein coextensive with one of the pair of side walls, the square recess having a lower surface comprised of a perforated grid, the open rear having an upwardly extending lip integral with a rear edge of the bottom wall of the main housing;

a toilet paper dispensing portion comprised of a pair of upwardly extending walls secured to the top wall of the main housing, each of the walls having a recess formed on an inner surface downwardly of free ends thereof, the toilet paper dispensing portion further comprising a spring biased spool adapted for removable securement between the upwardly extending walls within the recesses therein;

a deodorizer portion comprised of a tablet having an upper surface and a lower surface, the lower surface having an adhesive disposed thereon, the adhesive having a peel-away sheet disposed thereon, the tablet being dimensioned for securement to the perforated grid of the square recess of the main housing.

2. A multi-function toilet accessory comprising:

a main housing having a top wall having an elongated recess extending inwardly from an open rear thereof, the top wall having a square recess formed therein coextensive with one of a pair of side walls thereof, the open rear having an upwardly extending lip integral with a rear edge of the bottom wall of the main housing;

a toilet paper dispensing portion secured to the top wall of the main housing;

a deodorizer portion dimensioned for securement within the square recess of the main housing.

3. The toilet accessory as set forth in claim 2 wherein the elongated recess in the top wall extending more than three quarters of a width of the main housing.

4. The toilet accessory as set forth in claim 2 wherein the square recess of the main housing having a lower surface comprised of a perforated grid.

5. The toilet accessory as set forth in claim 2 wherein the toilet paper dispensing portion comprised of a pair of upwardly extending walls secured to the top wall of the main housing, each of the walls having a recess formed on an inner surface downwardly of free ends thereof, the toilet paper dispensing portion further comprising a spring biased spool adapted for removable securement between the upwardly extending walls within the recesses therein.

6. The toilet accessory as set forth in claim 4 wherein the deodorizer portion comprised of a tablet having an upper surface and a lower surface, the lower surface having an adhesive disposed thereon, the adhesive having a peel-away sheet disposed thereon, the tablet being dimensioned for securement to the perforated grid of the square recess of the main housing.

* * * * *